US012352455B2

(12) United States Patent
Saravanan

(10) Patent No.: US 12,352,455 B2
(45) Date of Patent: Jul. 8, 2025

(54) SMART AIR HANDLING ROBOT

(71) Applicant: Mikul Saravanan, Rochester Hills, MI (US)

(72) Inventor: Mikul Saravanan, Rochester Hills, MI (US)

( * ) Notice: Subject to any disclaimer, the term of this patent is extended or adjusted under 35 U.S.C. 154(b) by 376 days.

(21) Appl. No.: 17/726,698

(22) Filed: Apr. 22, 2022

(65) Prior Publication Data

US 2022/0390135 A1 Dec. 8, 2022

Related U.S. Application Data

(60) Provisional application No. 63/285,998, filed on Dec. 3, 2021, provisional application No. 63/197,618, filed on Jun. 7, 2021.

(51) Int. Cl.
*F24F 11/63* (2018.01)
*F24F 8/22* (2021.01)
(Continued)

(52) U.S. Cl.
CPC ..... *F24F 11/63* (2018.01); *F24F 8/22* (2021.01); *F24F 11/38* (2018.01); *F24F 11/77* (2018.01);
(Continued)

(58) Field of Classification Search
CPC ..... F24F 1/0328; F24F 1/0358; F24F 1/037; F24F 1/04; F24F 11/0008; F24F 11/30;
(Continued)

(56) References Cited

U.S. PATENT DOCUMENTS 3,804,942 A 4/1974 Wakamatsu
4,121,916 A 10/1978 Fricke
(Continued)

FOREIGN PATENT DOCUMENTS

CN 110089980 A 8/2019
CN 110542158 A * 12/2019
(Continued)

OTHER PUBLICATIONS

Knightscope, A Fully Autonomous Outdoor Security Robot, retrieved on Jul. 11, 2022 from https://www.knightscope.com/k5/, 5 pages.
(Continued)

*Primary Examiner* — Tameem D Siddiquee

(57) ABSTRACT

A smart artificial intelligence based mobile robot having an air purification, humidification, dehumidification, and ultra-violet cleaning-based system to remove pathogens is disclosed. The robot also acts as an emergency alert system for break-ins and human fall detection using AI algorithm. The mobile robot operates and navigates intelligently using real time data collected from the environment through various sensors and input devices. An object detection module may use inputs from the camera to recognize people, pets, and others by pre-trained machine learning data set. The mobile purification, humidity management and sanitizing robot includes a ball bearing for balance and a motor controller, which drives two motors and wheels. The central controller of the smart mobile robot system has memory and processor to handle navigation, communication, notifications, and air handling system through real time data collection.

8 Claims, 18 Drawing Sheets

(51) Int. Cl.

| | |
|---|---|
| ***F24F 11/38*** | (2018.01) |
| ***F24F 11/77*** | (2018.01) |
| ***F24F 110/20*** | (2018.01) |
| ***F24F 110/66*** | (2018.01) |
| ***F24F 120/12*** | (2018.01) |
| ***F24F 130/40*** | (2018.01) |

(52) U.S. Cl.
CPC ..... *F24F 2110/20* (2018.01); *F24F 2110/66* (2018.01); *F24F 2120/12* (2018.01); *F24F 2130/40* (2018.01); *F24F 2221/42* (2013.01)

(58) Field of Classification Search
CPC ..... F24F 11/32; F24F 11/38; F24F 11/526; F24F 11/54; F24F 11/63; F24F 11/77; F24F 2110/10; F24F 2110/20; F24F 2110/64; F24F 2110/66; F24F 2120/12; F24F 2130/40; F24F 2221/42; F24F 8/108; F24F 8/158; F24F 8/22
See application file for complete search history.

(56) References Cited

U.S. PATENT DOCUMENTS

| | | | | |
|---|---|---|---|---|
| 4,134,744 | A | 1/1979 | Peterson | |
| 5,141,706 | A | 8/1992 | Clark | |
| 5,230,720 | A | 7/1993 | Kendall | |
| 5,758,298 | A | 5/1998 | Guldner | |
| 5,837,020 | A | 11/1998 | Cartellone | |
| 7,276,100 | B2 | 10/2007 | Heuhn | |
| 7,837,958 | B2 | 11/2010 | Crasper | |
| 8,496,737 | B2 | 7/2013 | Kim | |
| 8,788,092 | B2 | 7/2014 | Casey | |
| 10,122,974 | B2 | 11/2018 | Cho | |
| 10,443,874 | B2 | 10/2019 | Tang | |
| 10,830,461 | B2 | 11/2020 | Xing | |
| 10,878,294 | B2 | 12/2020 | Jones | |
| 10,977,480 | B2 | 4/2021 | Corcodel | |
| 11,084,172 | B2 | 8/2021 | Casey | |
| 2008/0215184 | A1 | 9/2008 | Choi | |
| 2011/0208357 | A1 | 8/2011 | Yamanchi | |
| 2011/0232481 | A1* | 9/2011 | Worrilow | B01J 20/20 95/10 |
| 2011/0271839 | A1* | 11/2011 | Kim | B01D 53/72 96/111 |
| 2012/0194604 | A1* | 8/2012 | Tamaki | B41J 2/165 347/22 |
| 2012/0316680 | A1 | 12/2012 | Olivier, III | |
| 2015/0300892 | A1* | 10/2015 | Malhotra | H04L 12/2807 702/130 |
| 2016/0188977 | A1 | 6/2016 | Kearns | |
| 2017/0108236 | A1* | 4/2017 | Guan | G05B 19/042 |
| 2018/0340701 | A1 | 11/2018 | Baughman | |
| 2019/0021568 | A1 | 1/2019 | Kim | |
| 2019/0056125 | A1* | 2/2019 | Mou | F24F 11/65 |
| 2019/0370691 | A1 | 12/2019 | Chae | |
| 2020/0016764 | A1 | 1/2020 | Chae | |
| 2020/0029774 | A1* | 1/2020 | Mellinger, III | A47L 11/4061 |
| 2020/0051566 | A1 | 2/2020 | Shin | |
| 2020/0101183 | A1* | 4/2020 | Dijkstra | A61L 2/28 |
| 2020/0200407 | A1 | 6/2020 | Yang | |
| 2020/0274962 | A1 | 8/2020 | Martin | |
| 2020/0288694 | A1 | 9/2020 | Fu | |
| 2020/0297180 | A1 | 9/2020 | Kang | |
| 2021/0043065 | A1 | 2/2021 | Wright | |
| 2021/0046205 | A1 | 2/2021 | Copeland, Jr. | |
| 2021/0078172 | A1 | 3/2021 | Cao | |
| 2021/0125477 | A1 | 4/2021 | Kelly | |
| 2021/0145234 | A1 | 5/2021 | Landry | |
| 2021/0173045 | A1 | 6/2021 | Hu | |
| 2021/0298547 | A1 | 9/2021 | Moroniti | |
| 2021/0331326 | A1* | 10/2021 | Kim | A47L 11/28 |
| 2021/0341928 | A1 | 11/2021 | Sampaio Martins Pereira | |
| 2022/0063089 | A1 | 3/2022 | Levine | |
| 2022/0088241 | A1 | 3/2022 | Guy | |
| 2022/0110495 | A1 | 4/2022 | Carter | |
| 2022/0304529 | A1* | 9/2022 | Jones | A47L 9/28 |

FOREIGN PATENT DOCUMENTS

| | | | |
|---|---|---|---|
| CN | 108926295 | B | 11/2021 |
| CN | 109249404 | B | 11/2021 |
| CN | 109611963 | B | 11/2021 |
| CN | 113589740 | A | 11/2021 |
| CN | 113599920 | A | 11/2021 |
| CN | 113613681 | A | 11/2021 |
| CN | 113614784 | A | 11/2021 |
| CN | 214549278 | U | 11/2021 |
| CN | 214552009 | U | 11/2021 |
| CN | 214552323 | U | 11/2021 |
| CN | 214581589 | U | 11/2021 |
| CN | 214581631 | U | 11/2021 |
| CN | 214581671 | U | 11/2021 |
| EP | 3031375 | B1 | 11/2021 |
| EP | 3903910 | A1 | 11/2021 |
| GB | 2451069 | A | 1/2009 |
| IN | 202117034244 | A | 11/2021 |
| JP | 2021175592 | A | 11/2021 |
| KR | 20170086246 | A | 7/2017 |
| WO | 2015140776 | A1 | 9/2015 |
| WO | 2020051026 | A1 | 3/2020 |
| WO | 2020151918 | A1 | 7/2020 |
| WO | 2021202514 | A2 | 10/2021 |
| WO | 2021217372 | A1 | 11/2021 |
| WO | 2021220318 | A2 | 11/2021 |

OTHER PUBLICATIONS

Screen capture of webpage for YouTube video clip entitled "Reduce Pathogens on Environmental Surfaces with the Pathogon™ UV Disinfection System", uploaded Feb. 27, 2013 by user Steris, accessed Jul. 11, 2022 from URL: https://www.youtube.com/watch?v=99uSP_ife1o, 1 page.

Screen capture of webpage for YouTube video clip entitled "UV Disinfection Robot", uploaded Jul. 10, 2020 by user asrebo, accessed Jul. 11, 2022 from URL: https://www.youtube.com/watch?v=a7QXOYq7By4, 1 page.

Screen capture of webpage for YouTube video clip entitled "Autonomous mobile robot with UV-C air purifier", uploaded Jan. 29, 2021 by user ロボットスタート株式会社, accessed Jul. 11, 2022 from URL: https://www.youtube.com/watch?v=R1LUpJx31ag, 1 page.

"iTouchless UV-C Sterilizer Robot Vacuum Cleaner with HEPA Filter (Rose Gold) (Open Box)", accessed Jul. 11, 2022 from https://www.buydig.com/shop/product/ITCVC007ROB/iTouchless-UV-C-Sterilizer-Robot-Vacuum-Cleaner-with-HEPA-Filter-Rose-Gold-OPEN-BOX, 4 pages.

"Ring Alarm Glass Break Sensor", accessed Jul. 11, 2022 from https://ring.com/products/glass-break-sensor, 5 pages.

"AIT UV-C Air Sterilizer RT 'Steribot'"; Aichi Institute of Technology Robot Research Museum, accessed Feb. 3, 2022 from https://robotshowcase-jp.translate.goog/2020/robots/17.html, 2 pages.

* cited by examiner

SMART AIR HANDLING ROBOT

TECHNICAL FIELD

The present invention relates to smart robots and associated methods constructed and arranged to purify, humidify, dehumidify, and disinfect the air in residential environments. The invention also relates to smart robots and associated methods used for residential security.

BACKGROUND

Residential air purification has historically been handled in residential forced air systems primarily using dust filters. Air purifiers containing HEPA air filters and activated carbon filters are good at removing pollutants, but their ability to remove viruses from the air is minimal. The HEPA filters are proven to help reduce the pollutants in the air by trapping the particles for pollen, pet dander, dust, micro-organisms, and allergens such as mold and tobacco smoke. The activated carbon filter removes smells, VOCs (volatile organic compounds), gases, fumes, and chemicals. The combination of these two filters leads to cleaner air, less irritation of the nose and throat, and even better sleep.

Regular stationary air purifiers are not particularly good for cleaning the air in a big room. In these instances, periodically moving the small air purifier is required to clean the air in a large room. Whole-house air purifiers, such as those installed within HVAC systems still cannot clean the air in every part of the room. This is due to stagnant air in a few pockets of the room and poor airflow because of the lack of good air circulation.

UVC (Ultraviolet Type C) lamps can remove almost all viruses, including coronaviruses, from the air, increasing people's safety in that area. UVC can kill bacteria and viruses without harming humans when done with low direct contact with people.

The ideal humidity is between 40% and 60% for people's comfort, and anything out of this range can affect people's physical and emotional well-being. The extreme range of humidity affects the buildup of pathogens on wooden floors and furniture.

In a historically unrelated aspect of residential living, life-threatening medical emergencies in the home are typically handled by efforts to call 911 or family or friends using a land phone or a cell phone. However, when a person falls at home and becomes severely injured or enters an unconscious state, this option becomes limited. And in yet another historically unrelated aspect of residential living, when there are home invasions such as by window break-ins or other security threats, such as unusual loud noise like gunfire, the person attempts to hide and may not have a phone device to make an emergency call.

To solve these issues, multiple devices with various functions are typically needed in different rooms.

SUMMARY

It is therefore a general object of the invention to alleviate at least to some extent one or more of the above-noted problems of the prior art.

Various aspects of the invention are specified in the appended claims. Various other aspects of the invention are listed below.

One such aspect is related to the provision of an air handling robot containing a washable pre-filter, carbon filter, HEPA air filter, humidifier, dehumidifier, and UVC lamp to purify, humidify, dehumidify, and disinfect the air respectively. A smart robot navigates space and stops when its sensors detect poor air, humidity anomaly, or a person and cleans and disinfects the air for a period of time, based on the sensor readings. This approach provides an opportunity to evenly maintain the air quality and humidify in the space of its operation.

The mobile robot with real time environmental monitoring with situational awareness adapts to perform appropriate air handling tasks by adjusting the speed of the robot and time duration for that area.

Another such object of the invention is to alert users of a medical emergency when people fall on the ground. This may be done with the AI based object detection and image processing algorithm. The invention also alerts users when window glass break-ins are detected or unusually loud noises are detected using the sound processing module of artificial intelligence.

Another such object relates to the use of artificial intelligence for object detection and data processing to have smart, efficient air handling in the zone it operates and emergency monitoring.

In at least some embodiments, the mobile robot has at least one camera at the front to capture the current environment. The image and video are used primarily by the artificial intelligence module to detect people and pets. The audio from the microphone on the robot is processed by an artificial intelligence module to detect window break-ins and for other unusual loud noises. A live stream of the camera and microphone audio are available as an option on the smart device for users preview.

In accordance with yet another aspect of the invention, a mobile robot comprising an air purification system is disclosed. The smart mobile robot may be operated by a central controller developed to perform purification and humidification, dehumidification. The central controller may be configured to be in communication with a drive controller to handle two motors with inputs from ultrasonic sensors and a camera. The mobile robot includes a fan assembly configured to receive air from an environment. The mobile robot includes a pre-filter, and two filters configured to filter air between two fans, which operates in push-pull configuration. The mobile robot includes multiple air quality sensors, a humidity sensor, temperature sensor, two ultrasonic sensors, a microphone, an UVC light, a camera, and a filter-fan assembly.

In one embodiment, one or more filters comprises of a pre-filter, an activated carbon filter, and a HEPA filter.

In one embodiment, the HEPA filter may be configured to remove dust, pollen, pollutants, and airborne particles detected by the air quality sensor.

In one embodiment, the activated carbon filter may be configured to filter out odors, air contaminants including volatile organic compounds.

In one embodiment, the air received from the environment via the fan assembly, is filtered by one or more filters, wherein the filtered air is then contacted by the UVC light.

In one embodiment, the UVC light may be configured to handle pathogens by killing bacteria, inactivating viruses, and disinfecting the air from the environment prior to being released back into the environment.

In one embodiment, two ultrasonic sensors are configured to avoid obstacles and handle floor transition within an environment.

In one embodiment, one or more cameras are configured to perform object detection and detect people or pets in an environment.

In one embodiment, the central controller processes data using AI from the environment triggers the drive controller for optimal time, and moves the robot at variable speed in the airspace for better air quality.

In one embodiment, the air quality sensors are configured to detect if the air quality in the environment is outside of a predetermined threshold. This threshold can be configured by the user.

In one embodiment, the humidity sensor may be configured to detect if the air humidity is out of a predetermined threshold. This threshold can be configured by the user.

In one embodiment, the drive controller may be communicatively connected to a central controller. The central controller is configured to execute one or more smart AI algorithms to determine if the air in the environment is improved.

In one embodiment, the fan assembly includes a front fan configured to receive air from an environment, and a rear fan configured to push air into a chamber for disinfection by the UVC light.

In one embodiment, the drive controller may be configured to move the robot to one or more areas in the environment resulting in an even distribution of purified air with improved air quality.

In one embodiment, the mobile robot moves around and works as a multi-room air handling system.

In one embodiment, the mobile robot can be configured to be a stationary system for a certain time and duration at a specific area. This gives the user an option to perform air handling in that zone.

In one embodiment, the mobile robot has a wireless communication module to send and receive information to smart devices and also communicate to the cloud storage.

In one embodiment, the mobile robot has a temperature sensor and alerts the user through wireless communication for any anomaly. The threshold for temperature can be set by the user.

In one embodiment, the mobile robot may use a pre-trained machine learning algorithm, process the audio from microphone and camera images for emergencies such as a person falling or person already on the ground, window break-ins, unusual loud noises and alerts the user through wireless communication. An optional live stream from the camera and real time audio are shared to a smart device.

In one embodiment, the smart device settings in an app have scheduler module which can help set up the start and stop time of the robot for different days. This helps the user to schedule auto-run mode to control normal weekdays, weekends, vacation days and unusual heavy traffic timing like get-together and parties.

In one embodiment, the smart device settings in an app gives the option for a user to control robot in default auto mode or stationary mode or manual mode or zone, line follower mode.

In one embodiment, the robot can perform one or more combination of air filtration or removal of pathogens or humidify, dehumidify operation.

In one embodiment, the robot can perform one or more combination of alert modes related to medical emergency or intruder or air quality anomaly or temperature anomaly or humidity out of range or low battery or water tank empty or full or water tank leak alert.

In one embodiment, the smart device settings have an option to provide end of the day summary of cleaning log including timing, details of air quality, humidity and temperature.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF DRAWINGS

Disclosed herein are embodiments to illustrate the preferred mode in practice as part of the current invention. This description includes drawings for the purpose of general principles of the described smart robot and it is not to be taken in any limiting sense. In accompanying drawings and figures, same or similar components may have the same reference label.

Figure 1:
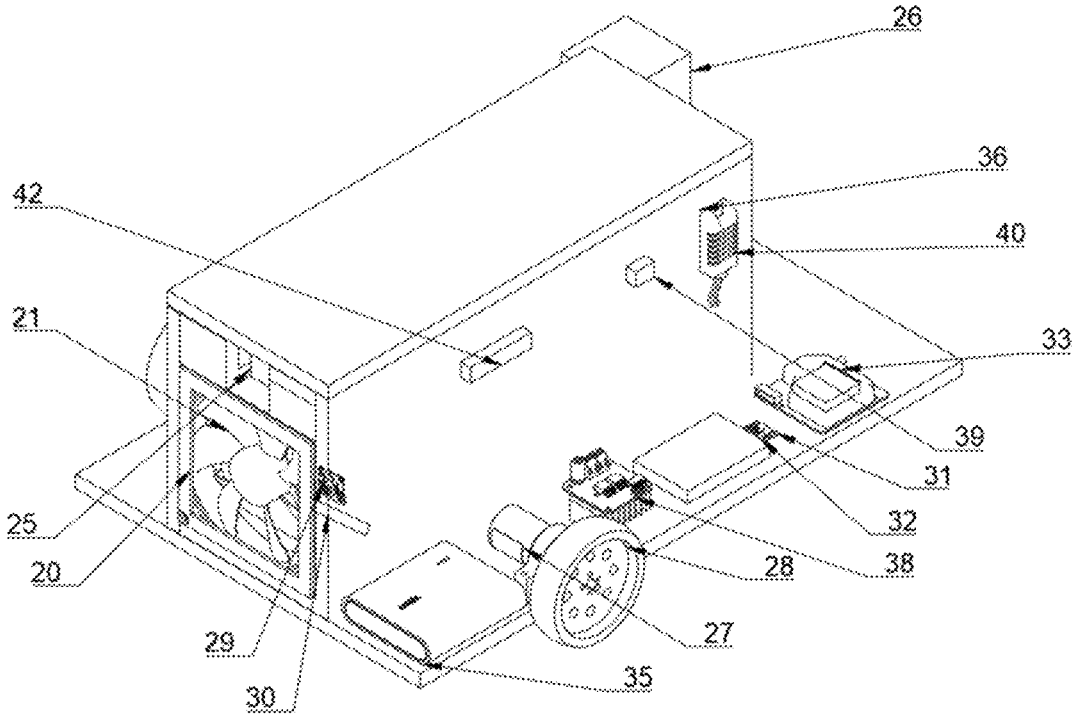
FIG. 1 image is the front-top schematic view as per preferred embodiments of the invention, in accordance with an example showing the front fan used for pulling the air in from the environment, battery pack, various sensors.

Elements in the figures are illustrated for simplicity and clarity and have not been drawn to scale. For example, the dimensions or relative positioning of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of these various embodiments. Certain actions or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION OF EMBODIMENTS

Detailed descriptions of various embodiments of a smart robot are provided herein. It is to be understood, however, that a smart robot may be embodied in various forms. Therefore, specific details disclosed herein are not to be interpreted as limiting, but rather as a basis for the claims and as a representative basis for teaching one skilled in the art to employ a smart robot as described. The invention be embodied in many alternate forms and should not be construed as limited to only the embodiments set forth herein.

The invention may be embodied in other specific forms without departing from the spirit of essential characteristics thereof. The present embodiments therefore should be considered in all respects as illustrative and not restrictive, the scope of the invention being indicated by the appended claims rather than by the foregoing description, and all changes which come within the meaning and range of equivalency of the claims are therefore intended to be embraced therein.

The terminology used herein is for the purpose of describing particular embodiments only and is not intended to be limiting of the invention. As used herein, the term "or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof.

The following description is not to be taken in a limiting sense but is made merely for the purpose of describing the general principles of exemplary embodiments. Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but no other embodiments.

A first embodiment of a smart air handling robot is shown in FIGS. 1 to 7; the robot can purify air by intaking air from the environment through a washable pre-filter 20 and front fan 21. With reference also to FIG. 8, the air may be then pushed through a carbon filter 24 and then to a HEPA filter 22. A fan 23 helps to increase airflow by pushing the air after HEPA filter 22 into a disinfectant chamber 142. A UVC lamp 25 inside the disinfectant chamber may be oriented downward so that the UVC light energy may be primarily directed towards the moving air to help maximize the removal of germs. This arrangement of UVC light also avoids direct contact with people and pets since it is substantially or entirely contained within a chamber 142. Additionally, the airflow may be slightly higher at the top of the disinfectant chamber 142, so the UVC light has more contact with air at a quicker pace. The UVC light may include wavelengths in the range of 100 to 280 nm and includes those that destroy pathogens. UVC light disinfects the air by killing up to at least 99.99% of bacteria and inactivates viruses including coronaviruses such as SARS-CoV-2. The air after getting sanitized exits the disinfectant chamber 142 and back into the room in which the robot is located.

The sanitized air comes through the humidity management module 26, which may be the back end of the robot. The smart robot has humidifier unit 26 as in FIG. 1. The purified air coming out of the disinfectant chamber would include the humidity produced by the humidifier to ensure better humidity throughout the room. The humidifier may be strategically placed at this location to efficiently spread the humidified air, parallel to the floor. This is done as humid air (compared to dry air) rises upwards. The humidifier can be replaced with a dehumidifier as a plug-and-play when the area has higher humidity than normal.

Figure 7:
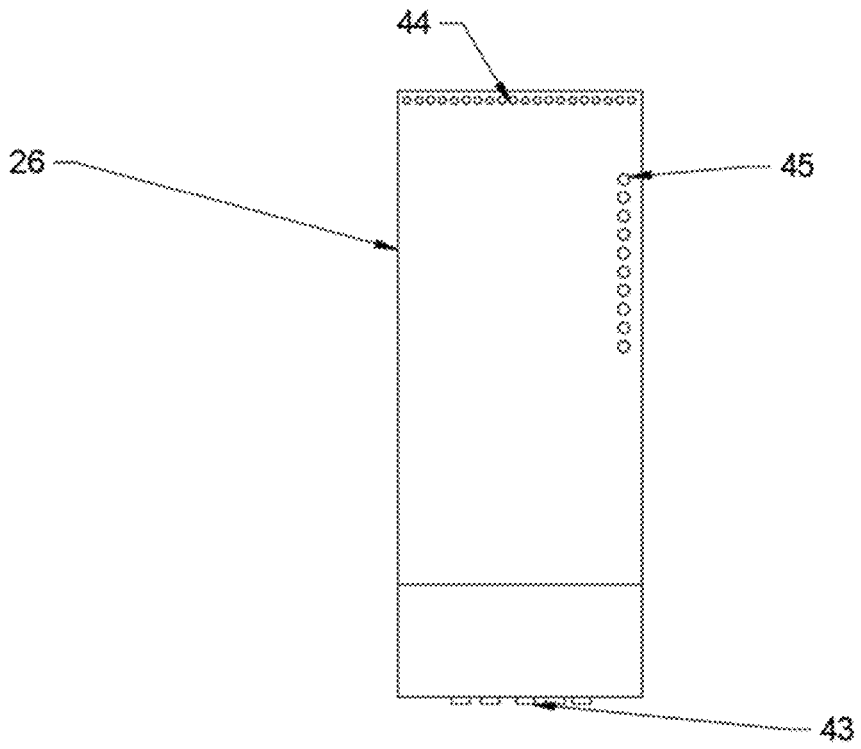
FIG. 7 image is the schematic view of the dehumidifier module of the robot which looks identical when replaced with humidifier unit at this location.
Figure 8:
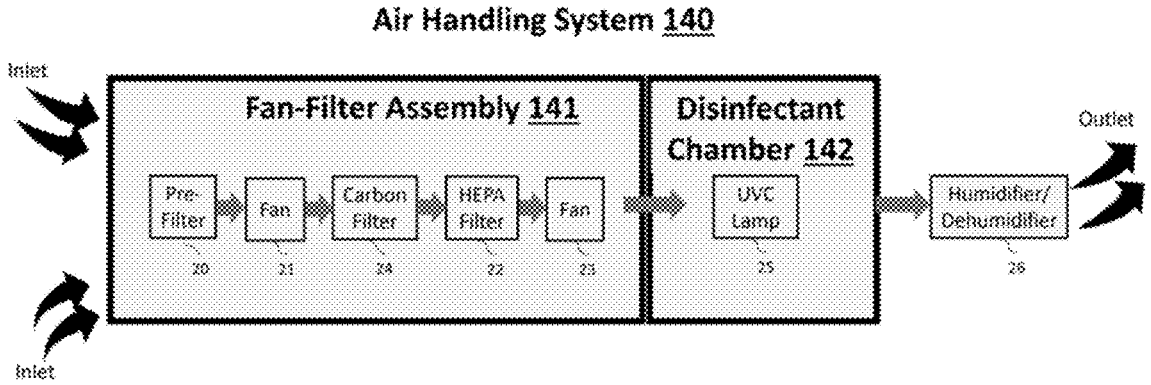
FIG. 8 image is the example view of the flow of air through the fan-filter assembly and then into disinfectant chamber as part of air handling system along with humidity management.

FIG. 7 shows what the dehumidifier would look like when replaced with a humidifier as module 26. Both humidifier and dehumidifier modules may have pins 43 at the bottom so that they can interface with the central controller. The air inlet 44 for the dehumidifier comes from the top and leaves to the right 45 so that humidity can be removed. The chamber at the top portion of this module collects the water. The electronics for the dehumidifier are at the bottom of this module.

As shown in FIGS. 1 through 7, and diagrammatically in FIGS. 8-17, the main body also referred to as a base 34 holds various components for the operation of the robot. The air handling system 140 may be mounted in the middle of the base. The first part of the air handling system may 140 be a fan-filter assembly 141 and the second part may be a disinfectant chamber 142. The pre-filter 20 may be housed as a removable unit at the front of a fan 21. This may be a washable pre-filter to catch larger particles such as hair, dust, pet fur, fibers, lint, and other things that floats in the air. The pre-filter increases effectiveness and lifespan of the downstream filters 22 and 24. The fan 21, carbon filter 24, HEPA filter 22 and fan 23 may be all mounted as detachable units one behind another, as part of the air handling system. The air sanitizing system consists of disinfectant chamber 142 with UVC lamp 25 mounted inside as a module next to fan 23.

Figure 2:
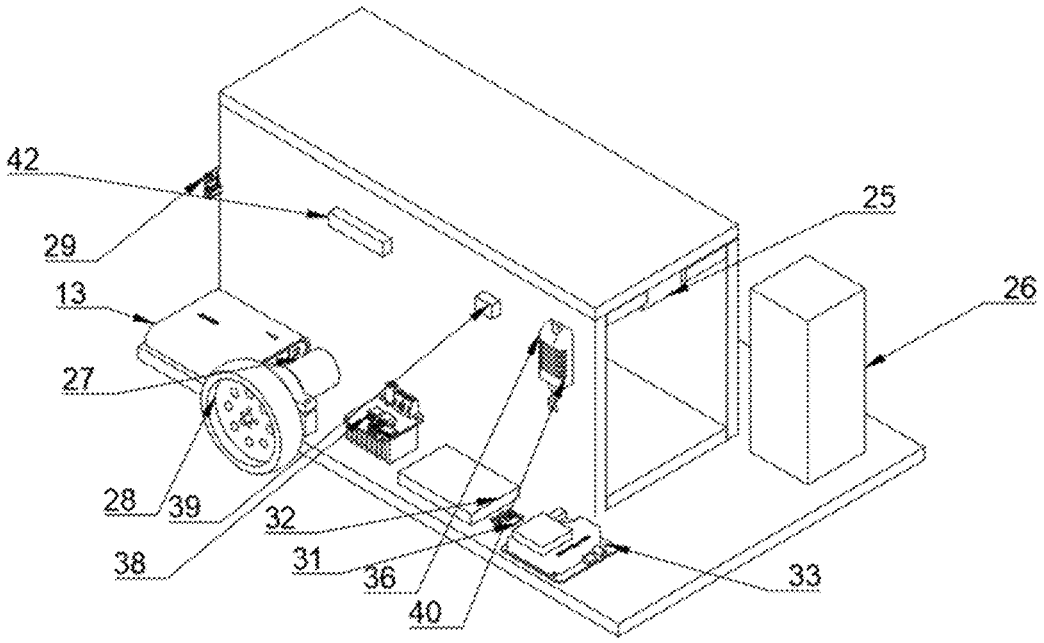
FIG. 2 image is the back-top schematic view of the robot as per preferred embodiments of the invention, in accordance with an example shows the exit of the air from the chamber and the humidifier, dehumidifier adjacent to it.
Figure 3:
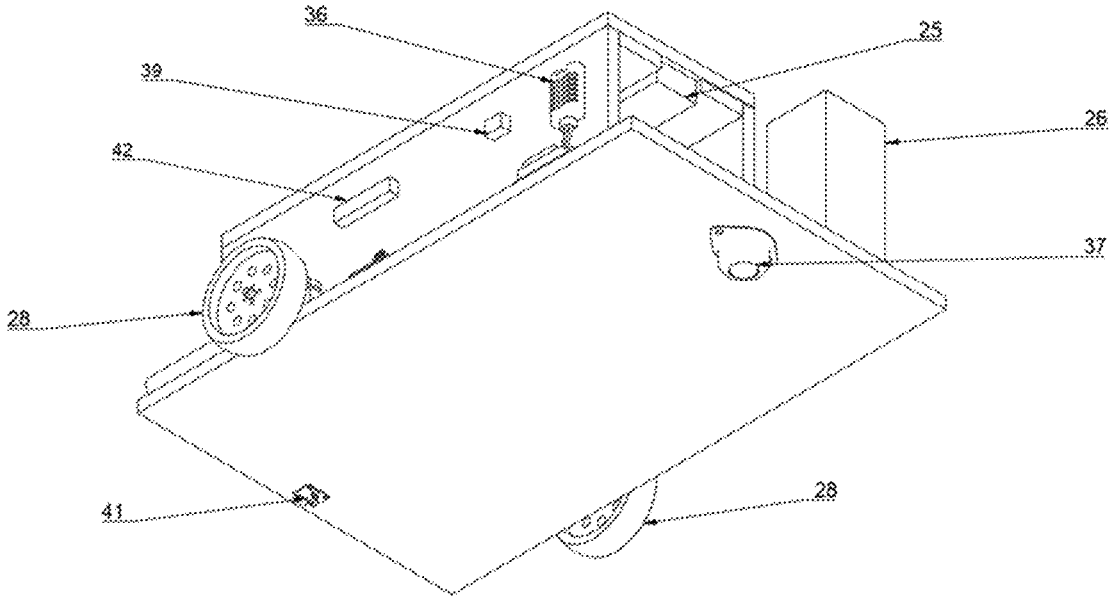
FIG. 3 image is the back underside schematic view of the robot with the two motors, and two wheels on either side, ultrasonic sensor towards the front and ball bearing at the rear as per various embodiments of the invention.
Figure 4:
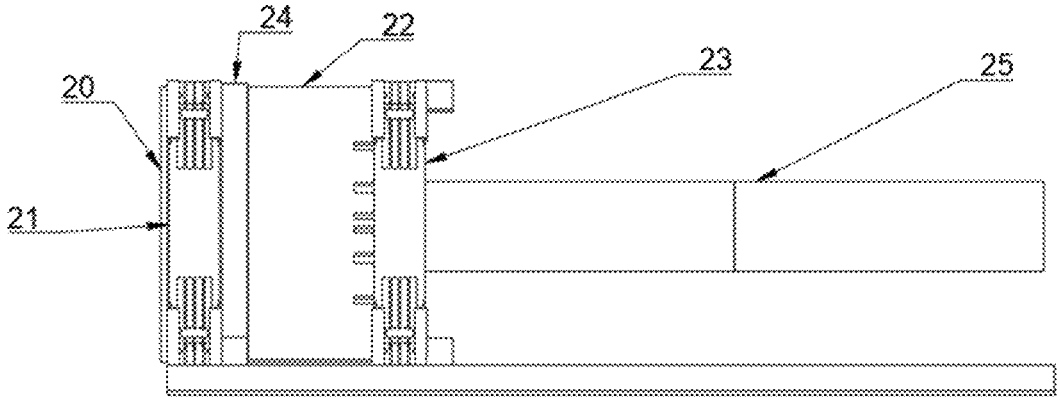
FIG. 4 image is the side schematic view of the robot, showing the air chamber where air flows from left to right.
Figure 9:
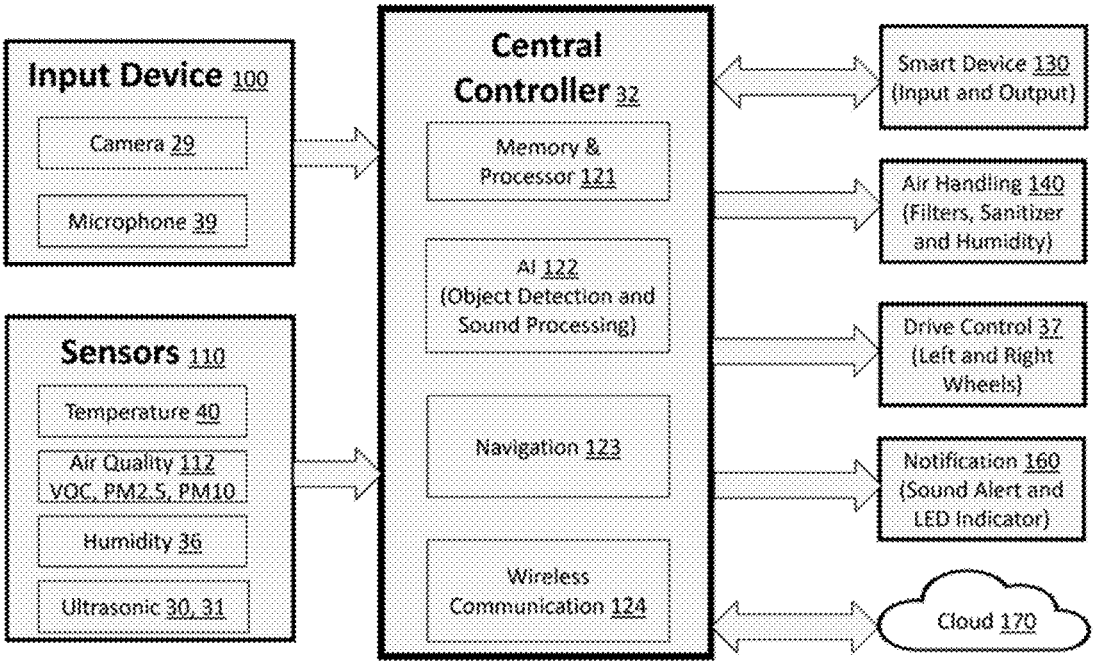
FIG. 9 is the functional block diagram of various modules, components and devices illustrating a data processing and AI environment, configured to improve air quality and provide emergency alerts.

A central controller 32 may be mounted on the top of the base on one side of the air handling system as shown in FIGS. 1 and 2. The central controller 32 as shown in FIG. 9 contains a computer-readable memory 121 and an electronic processor 121; which receives data from sensor system 110, camera 29, and microphone 39 to perform multiple operations including AI 122 to process the data for navigation 123 of the smart robot, provide notifications 160 and communicate 124 to a smart device and cloud 170. The smart robot central controller has the capability to receive various inputs from smart device 130.

A drive controller 38 mounted on a base 14, receives instruction from the navigation module 123 of the central controller 12. The drive controller in turn provides instructions for the speed and direction change for each of the left and right motors 27. The motor may be mounted on either side of the air handling system on a base 34. The two wheels 28 moves with power and control from two individual motors 27. The two wheels 38 may be mounted on either side of the base. The two motors independently drive its wheels. There may be a metal ball bearing 37 mounted at the back of the robot, that always keeps the robot stable.

A sensor system 110 has multiple sensors mounted around the main body 22 to obtain real-time air quality data and other metrics of the surrounding.

The VOC sensors 31 may be used to measure a wide range and levels of volatile organic compounds intended for indoor air quality monitoring of the environment. The VOC sensors may be mounted to the top of the base unit, as shown in FIGS. 1 and 2. The sensor can measure total volatile organic compound concentration within a range of 20 to 1000 parts per billion (ppb) with about 2% to 5% error. It can detect alcohols like benzene, toluene, formaldehyde. It also detects aldehydes, ketones, organic acids, amines, organic chloramines, aliphatic and aromatic hydrocarbons.

The particulate matter sensors PM2.5 and PM10 33 may be used to detect smoke particles from 0.10 μm to 1.0 μm diameter, dust particles from 0.50 μm to 3.0 μm diameter, and pollen particles with size from 5.0 μm to 11 μm in diameter. The particulate matter per 100 ml air, is categorized into 0.3 μm, 0.5 μm, 1.0 μm, 2.5 μm, 5.0 μm, and 10 μm size bins. The PM sensors 33 may be mounted on the top of a base 34 as shown in FIGS. 1 and 2.

The humidity sensor 36 used to measure humidity levels between 0 to 100% with 2 to 4% accuracy. Normally the sampling can be obtained every 2 seconds. This sensor 36 may be mounted on the top rear end of the air quality system, as shown in FIGS. 1 and 2.

The temperature sensor 20 used to measure reading between −40° F. and 150° F. with ±0.5° F. accuracy. This sensor may be mounted alongside of the humidity sensor, as shown in FIGS. 1 and 2.

Figure 5:
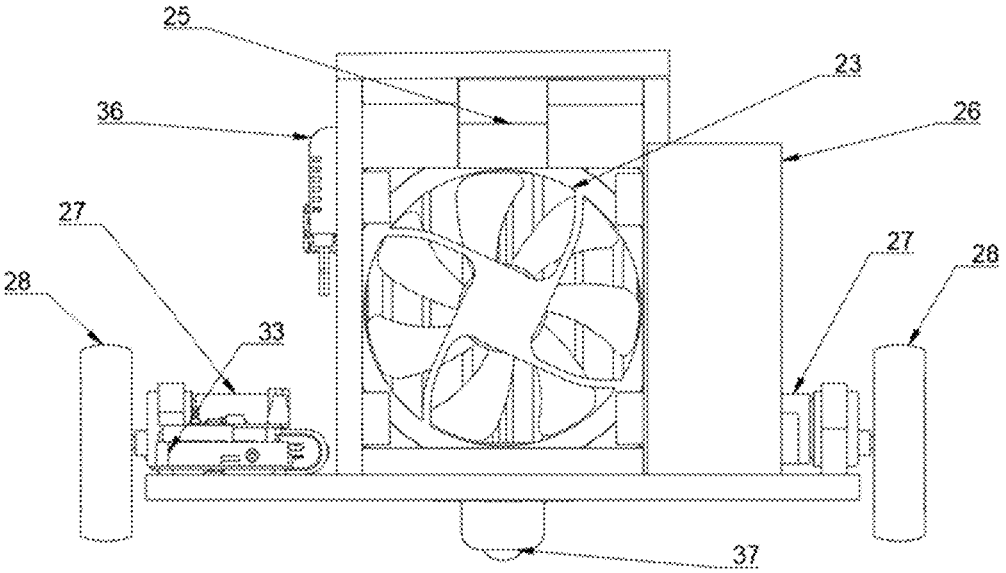
FIG. 5 image is the front schematic view of the robot where the front fan, camera, and two wheels are more clearly visible.
Figure 6:
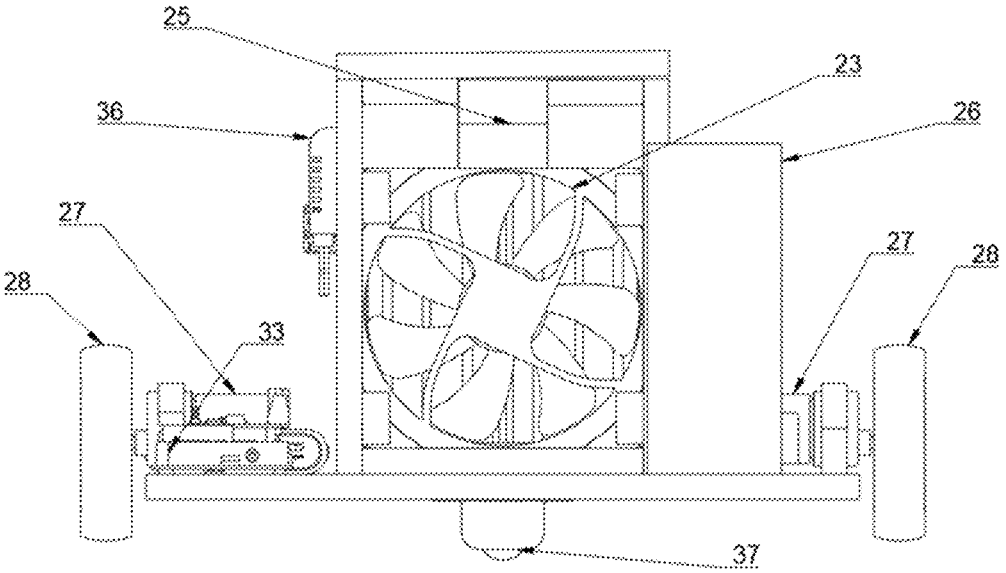
FIG. 6 image is the rear schematic view of the robot where the rear fan through the disinfectant chamber is visible along with a rear ball bearing.

The ultrasonic sensors 30 and 41 may be used avoid obstacles and floor transition within an operational space of the smart robot. The ultrasonic sensor 30 used for obstacle management may be mounted at the front face of the air handling system as shown in FIGS. 1 and 5. The ultrasonic sensor 41 used for cliff management to handle the floor transitions, so that the smart robot system can change directions and prevent a sudden fall. This ultrasonic sensor 41 may be mounted at the bottom of the base towards the front as shown in FIG. 1. The ultrasonic sensor 30 can detect obstacle between 0.8" to 20'. The ultrasonic sensors provide reliable results even during normal dust conditions.

Figure 12:
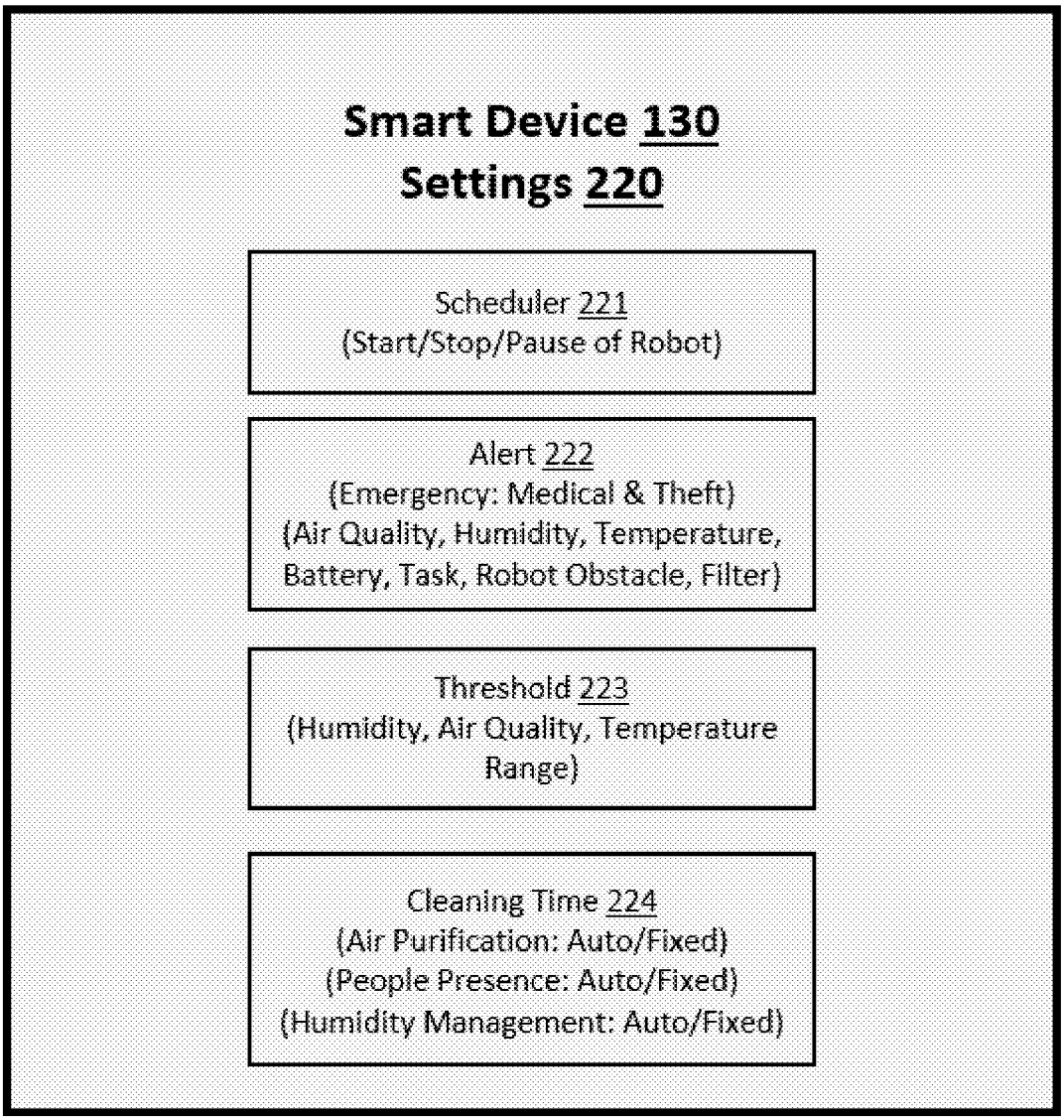
FIG. 12 is an example of smart device settings for user to have a scheduler, set alerts, settings for thresholds, and cleaning time.

A microphone 39 may be used to capture audio in the environment. This may be mounted on the side of the air handling system as shown in FIGS. 1, 2 and 5. The frequency response range may be from 15 Hz to 20 kHz. This microphone can capture the glass shattering waves which may be roughly 556 hertz. The data from a microphone may be fed through AI module 122 of the central controller 32 for sound processing. As in FIG. 16, the emergency alert system starts S301, when the robot may be powered ON S101. The emergency alert may be ON by default unless the user changed the mode through Alert Settings 222 in a smart device as shown in FIG. 12. This AI system receives audio S310 and processes sound S311 by using pre-trained models. The AI system detects intrusions by glass breaking or unusually loud noise in the surrounding S312. If this anomaly may be noticed, then it processes emergency alert S330, by notifying through sound 160 on the robot and with wireless communication 124; it performs specific alerts for breaks ins or unusual load noise 231*b* to a smart device. During an emergency, the camera and audio come through as live stream 232 on the smart device.

A camera 29 may be mounted on the front face of the air handling system as shown in FIGS. 1 and 5. The camera provides a video feed to the AI-based object detection module 122 of the central controller 12 as shown in FIG. 9. As in FIGS. 34 and 35, the data may be received S220 and pre-trained AI module process S221 to detect people, pets, and objects. When a person S222 is detected with data from a camera and by the AI module; the AI module hand over one control to the navigation module to check for distance S223 and the next portion of the AI module may be triggered to further process S323 as in FIG. 16, to see if the person has fallen on the ground. When an anomaly is triggered, the smart robot notifies 160 by sound on the robot and with the wireless communication 124, sends the medical emergency alert 231*a* to smart device notification. During this emergency, the camera and audio comes through as live stream 232 on the smart device.

A battery pack 35, as shown in FIGS. 1 and 2, powers all electronics onboard the main body 34. A power supply and adapter may be used to charge the battery pack when the robot is turned off and docked to the regular wall power supply. The fans 21 and 23, humidity module 26, central controller 32, and drive controller 38 may be powered by a battery pack 35. The various sensors: VOC sensor 31, the PM2.5 and PM10 sensors 33, the humidity sensor 36, the temperature sensor 40 and Ultrasonics sensors 30, 41 may be powered by central controller and in operable communication with the central controller. The two input devices for audio and video: microphone 39 and camera 29 may be powered by central controller and in operable communication with the central controller. The drive controller 38 powers the motors 27 which in turn rotates the wheels 28 for the smart robot to traverse the floor. The sound and LED indicator 42 may be powered by central controller and may be connected on the side of the air purification system as in FIG. 1.

As shown in FIG. 8, the smart robot may be considered as integrating three core technologies for air handling system 140 namely the air purification system 141 containing multiple filters, disinfectant chamber 142, and humidity management module 26. In one embodiment, the filters may be pre-filter 20, carbon filter 24 and a HEPA filter 22. These types of filters, however, do not limit the types of filters and any filter is contemplated to be suitable for the air purification device.

Figure 15:
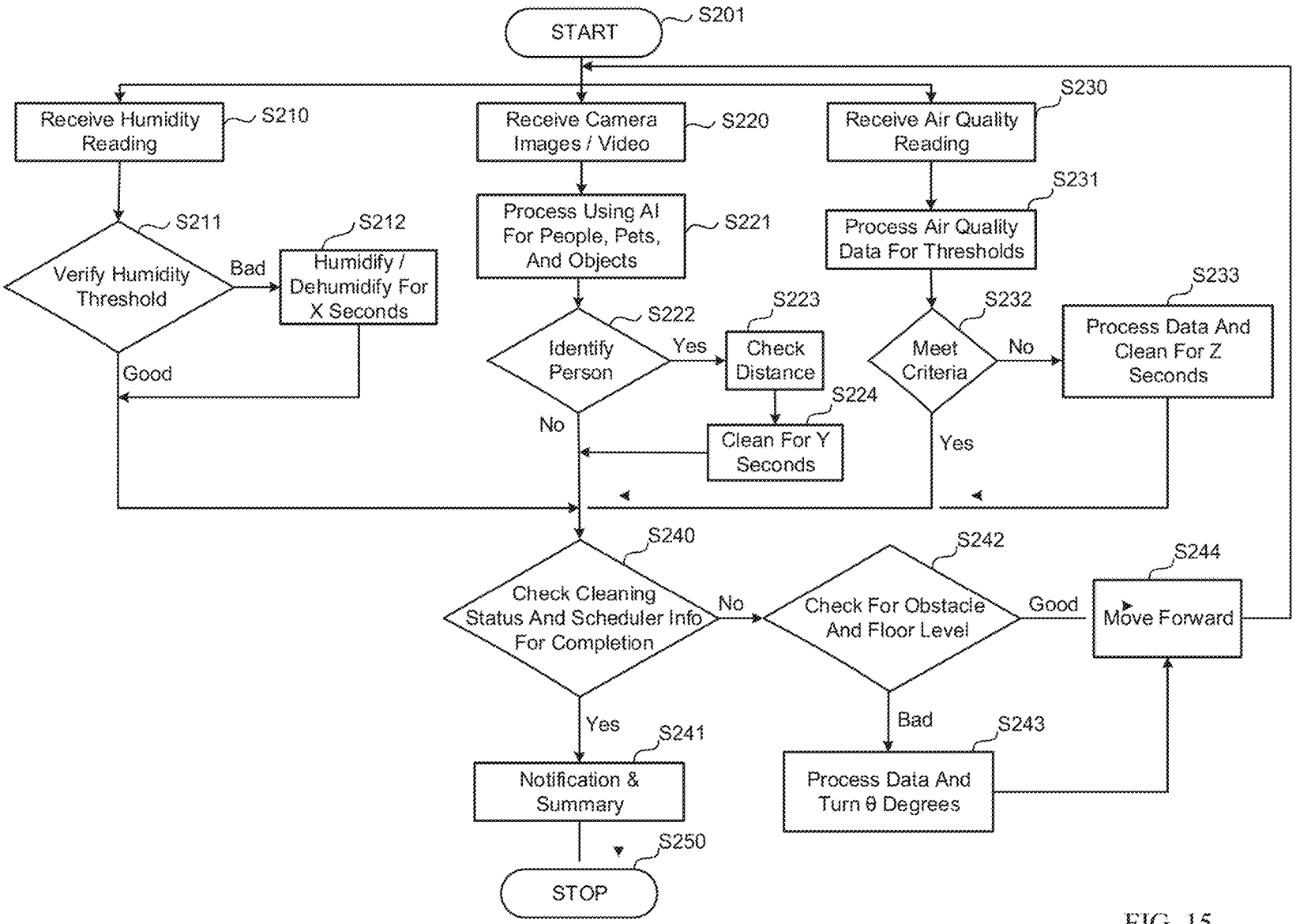
FIG. 15 is a flow chart illustrating the method of operation of using the data from air quality reading, humidity reading, image processing for people using AI and obstacle handling to improve air quality.

The navigation module 123 as in FIG. 9 may use data from ultrasonic sensors 30 for obstacle management, ultrasonic sensors 41 for floor transition, air quality data from sensors 112, humidity data from sensor 36, AI object detection algorithm 122 for people recognition with inputs through camera 29. FIG. 15 shows the flow of controls as part of the navigation module, when the smart robot is turned on or running S201.

A detailed block diagram of the flow of data related to the navigation module 123 is shown in FIG. 15. Here, humidity sensor 36 provides the humidity reading S210. This data may be checked to see if they are within the humidity threshold S211. The ideal humidity range between 40% and 60% may be used as default. However, this threshold value 223 can be modified by user through smart device 130 settings 223, as in FIG. 12. When the humidity level is low or high, then humidifier or dehumidifier would run for X additional seconds S212 at this location based on the logic programmed inside the navigation module. After this S212 or when the humidity threshold is good, then the navigation system flags internally that this is satisfied and would continue into next step S240, waiting for cleaning status on the person and air quality.

Inside the navigation module as in FIG. 15, as a parallel process, the camera feed may be received S220 for images and videos. This data may be processed using AI for people, pets, and objects S221. This detection may be accomplished through the pre-trained models of the AI-based algorithm. When the AI module detects a person S222, the smart robot looks for distance S223 of the person using the ultrasonic sensor. Based on these data, the program as part of the navigation module calculates the additional cleaning time of Y seconds S224, at this location. After this S224 or when no person is identified, then the navigation system flags internally that this is satisfied and would continue into the next step S240, waiting for cleaning status on the humidity and air quality.

Inside the navigation module as in FIG. 15, as a parallel process, the air quality reading S230, may be received from air quality sensors 112. This data may be processed S231, to see if they meet the thresholds of various air quality metrics criteria S232. One criterion for the particles sizes per volume may be below 15.0 $\mu g/m^3$ or 12.0 $\mu g/m^3$. One criterion for the particles size by diameter may be 1.0 μm, 3.0 μm, and 11μ for smoke particles, dust particles, and pollen particles respectively. One criterion for maximum allowable air concentration of total VOC may be below 0.50 $mg/m^3$. The value for the threshold could be set by the user settings 223 within smart device 130, as in FIG. 12. When the air quality threshold is not met, then based on the air quality data, the navigation module determines the need to run the smart robot at this location for additional Z seconds S233. This auto calculation can be overwritten with fixed value by user setting 224, in smart device as shown in FIG. 12. After this S224 or when no person is identified, then the navigation system flags internally that this is satisfied and would continue into next step S240, waiting for cleaning status on the humidity and person detection.

The navigation module calculates and uses the maximum of X or Y or Z seconds to stay in one location. This cleaning time calculation can be overwritten with fixed value 224 by user setting 220, in smart device 130 as shown in FIG. 12. This maximum time for one location may be limited to about 30 seconds when the smart robot operates in default autonomous mode 201 and about 300 seconds when the smart robot operates in zone mode 203. There is no maximum time for stationary 202 and manual 204 modes. Change to this maximum time are contemplated and could be modified with update to the software of the smart device.

When all relevant cleaning is done at any instance of time in a location of the smart robot S240, one of the processes inside the navigation module checks for completion based on the settings through scheduler 221. As part of the process in the navigation module, when the cleaning continues S240, the smart robot checks for obstacles and floor level S242 using the data from ultrasonic sensors 30 and 41. As needed the smart robot rotates by 0 degrees S243 based on the data received and processed real time. Then the robot moves forward S244. From here on the cycle of parallel process S210, S220, S230 continues. If the schedule S240 is satisfied, then the process of notification and summary is executed S241. During this process, notification by sound and LED light 160 on the robot takes place. Additionally, a detailed summary is sent to smart device 130 and cloud 170.

In one embodiment, filters 24 and 22 can be detached and removed, so the smart robot can perform as an air sanitizing system with the operation of UVC lamp 5 inside the disinfectant chamber 142.

In one embodiment, the speed of the fans 21 and 23 can be adjusted for controlling the flow rate of air through the fan-filter assembly 131 and through disinfectant chamber 142. The change from the default speed is handled by the central controller 32 based on the real time data processing of information received through air quality sensors 32.

In one embodiment, the UVC light intensity may be controlled by varying the power to UVC unit by the brain 32 of the smart robot. This can be set by the user through smart device 130 as a selection 210 as in FIG. 11 for on-off and intensity selection 212. The setting information is received through the wireless communication 124 as part of the central controller 32 as in FIG. 9.

In one embodiment, as in FIG. 8, the smart robot for air handling 140 may have a fan-filter assembly 141, a disinfectant chamber 142, and humidity management 26. The method includes receiving air from the environment through a front fan assembly. The method includes the flow of the air through a filtration assembly comprising of three filters configured to filter air received from the front fan assembly. The method includes a rear fan to pass the filtered air received in the filtration assembly into the UVC chamber. The method includes inactivating bacteria, viruses, in the filtered air via a UVC light, resulting in purified air. The method includes releasing the purified air through the back of the chamber into the environment. The smart robot, during the process of air handling in the environment, would need to move around and avoid obstacles. The central controller 32 may include a memory and processor 121, an AI 122 module program for object detection and sound processing, a navigation 123 module program to move the smart robot around, a wireless communication 124 to work with smart devices and the cloud. The processor 121 additionally helps for notification 160 on the smart robot. The wireless communication 124 receives and sends data to smart device 130 and cloud 170. The navigation module 123 controls the motor through drive controller by processing data received from input device 100 and sensors 110, which are all part of the robot. The microphone 39 and camera 29 feed are used by AI module 122. The pre-trained AI based object detection algorithm may detect people, so that the smart robot can go closer to them and purify longer.

Detected unusual people positions and loud noise are also used for emergency alert system as part of AI module.

Figure 10:
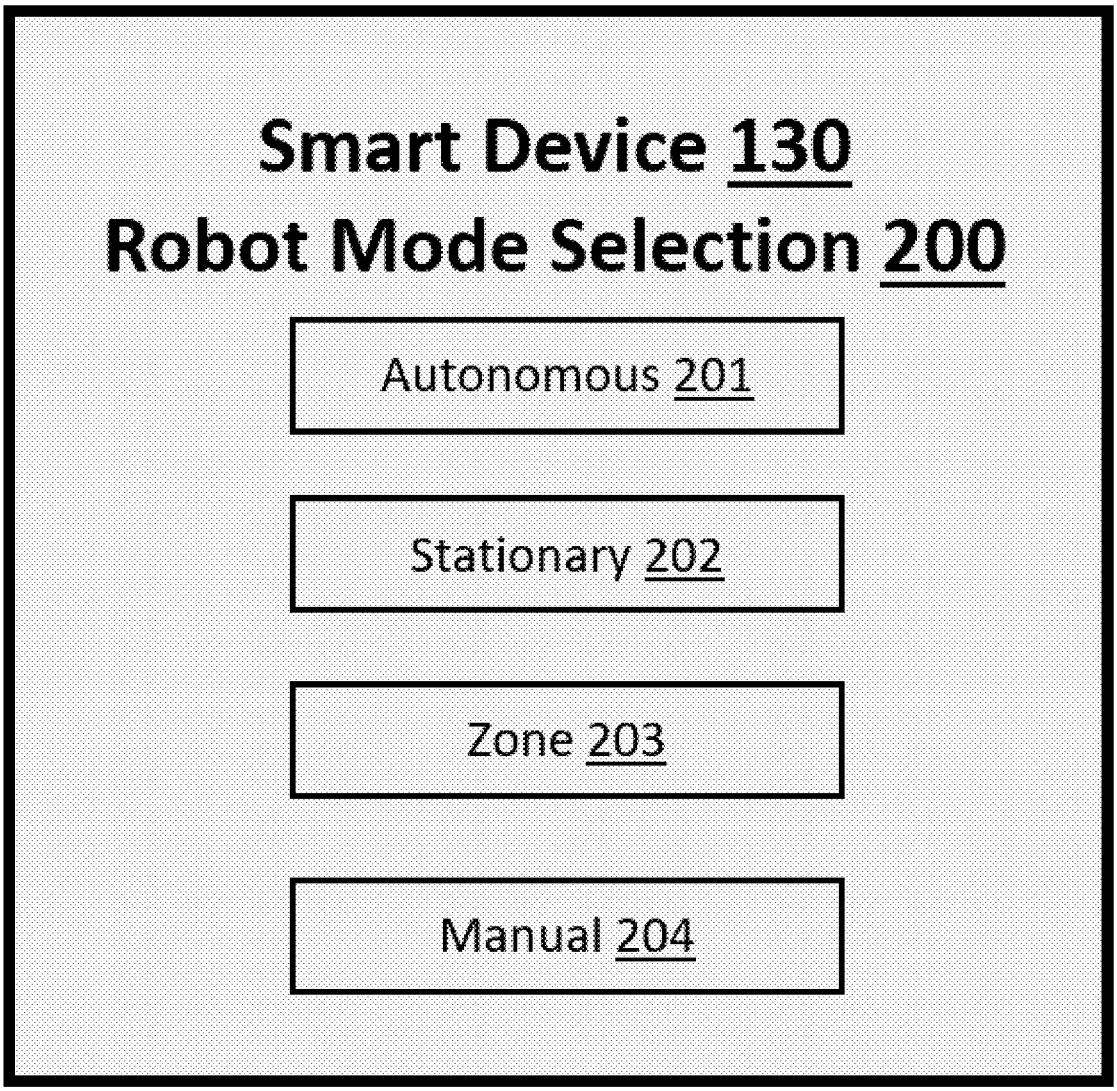
FIG. 10 is an example block diagram of robot mode selection through smart device, to control a smart robot.

As in FIG. 10, this smart robot works well in residential or commercial space in autonomous mode 121 as a default mode. No pre-configuration or mapping is needed as part of using the robot. This robot with its inbuilt ultrasonic sensors 30, 41, cameras 29 and drive controller 38 is programmed to move around intelligently. The robot is configured to move with two wheels 28 powered by at least two motors 27 individually. There is a metal ball bearing 37 at the back that keeps the robot stable. The robot moves forward until it detects anomaly for air quality, people and humidify and stops or moves at slower speed to clean the air. The users can change the setting to zone mode 203 by having the smart robot operate in a line follower mode or closed loop mode. The smart robot can be made to operate in a stationary mode 202 by working its air handling based on the readings. The smart robot can be operated in manual mode 204 using the smart device.

Figure 11:
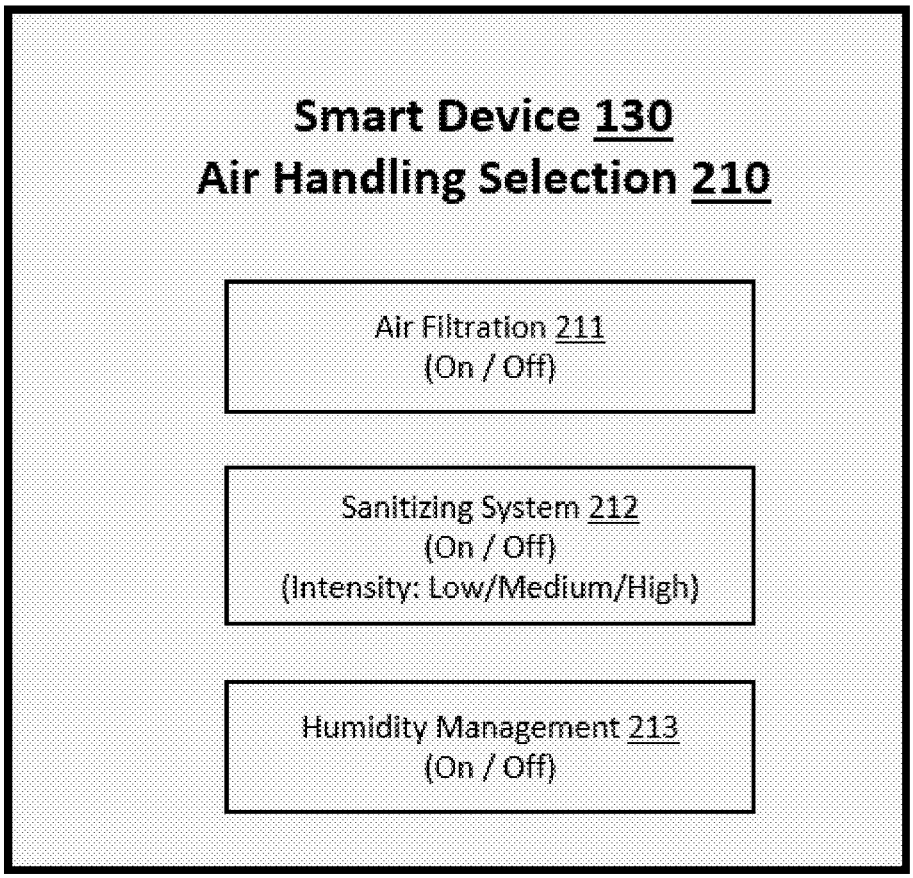
FIG. 11 is an example of smart device air handling selection for a user to change a default to off mode for air filtration module, disinfectant module and humidity management.

FIG. 11 shows the current air handling selection 210 as part of the smart device 130 feature. The default mode of sanitizing system 212 is ON. The UVC light intensity can also be controlled here when this is ON. The user can turn this off by selection if they want to disable the UVC system. When the mode is OFF, then disinfectant chamber 142 would be powered off by the smart robot. The default mode of air filtration 211 is ON. The user can turn this off by selection. When the user has air filtration 211 OFF then it is preferred to have sanitizing 212 also OFF. If user wants to keep only sanitizing 212 ON, which is unusual, then the user can remove the carbon filter 4 and HEPA filter 2 modules physically, so air flows well through disinfectant chamber 142.

FIG. 12 shows the various settings selection 220 as part of the smart device 130 feature. Through a scheduler 221 users can set the smart robot to run at a certain time of the week. The user can also overwrite this by using the calendar mode for various days. The robot during operation provides various alerts 222, which are ON by default. The user can choose to turn them off, in which related control systems and sensors would be turned off. The two emergency alerts may include one for medical and another for theft. The metrics alert may include air quality, humidity, and temperature. The functional alerts may include a battery, task completion, robot stuck into an obstacle, or filter change alert. The threshold can be changed to overwrite the default 223. The humidity default is 40% to 60%, even though in some cases 35% is acceptable as worse case lower end. The particles matter sizes of above 35.5 $\mu g/m^3$ are alerted to users as these are unhealthy for longer than 24-hour exposure. The sizes between 12.1 to 35.4 $\mu g/m^3$ are alerted to users as these are moderately healthy for 24-hour period. The particles matter size of below 12.0 $\mu g/m^3$ is considered good. For Total Volatile Organic Compounds (TVOCs), a maximum allowable air concentration of less than 0.30 $mg/m^3$, 0.3 to 0.5 $mg/m^3$, 0.5 to 1.0 $mg/m^3$ and 1.0 to 3.0 $mg/m^3$ are considered good, acceptable, marginal, and high respectively. For formaldehyde, a level is 0.75 ppm needs action and below 0.40 ppm is considered good. For temperature the threshold of 55° F. to 90° F. is set as default threshold. Future changes are contemplated and can be updated to the smart robot as software update.

Figure 13:
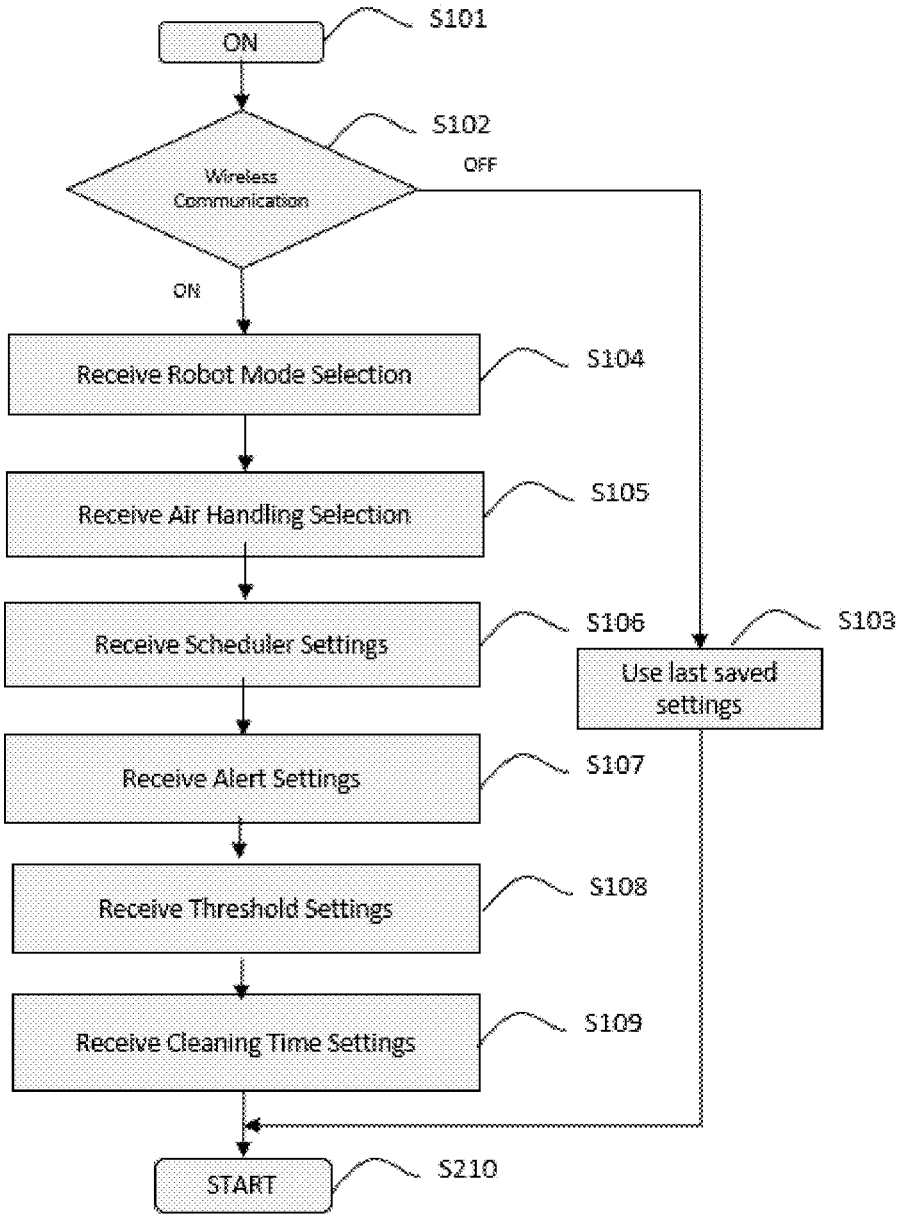
FIG. 13 is a flow chart illustrating operational steps when a smart robot is turned on to receive various settings and modes from a smart device through wireless communication modules.

FIG. 13 shows the flow of settings from the moment a smart robot is turned on S101 and ready to start S210 its work. The smart robot wireless communication module 124 looks to see if the wireless communication S102 with a smart device is active. If this is not connected, then the robot uses the last saved settings S103 to start. When the last saved settings do not exist, the smart robot starts with default programmed settings. If connected, then the wireless communication module may receive from smart device robot mode selection S104, air handling selection S105, schedule settings S106, various alert settings S107, threshold settings S108 and cleaning time settings S109. Once the robot receives settings from smart device 130, it starts S201 the work of air handling and emergency alert operations appropriately.

Figure 14:
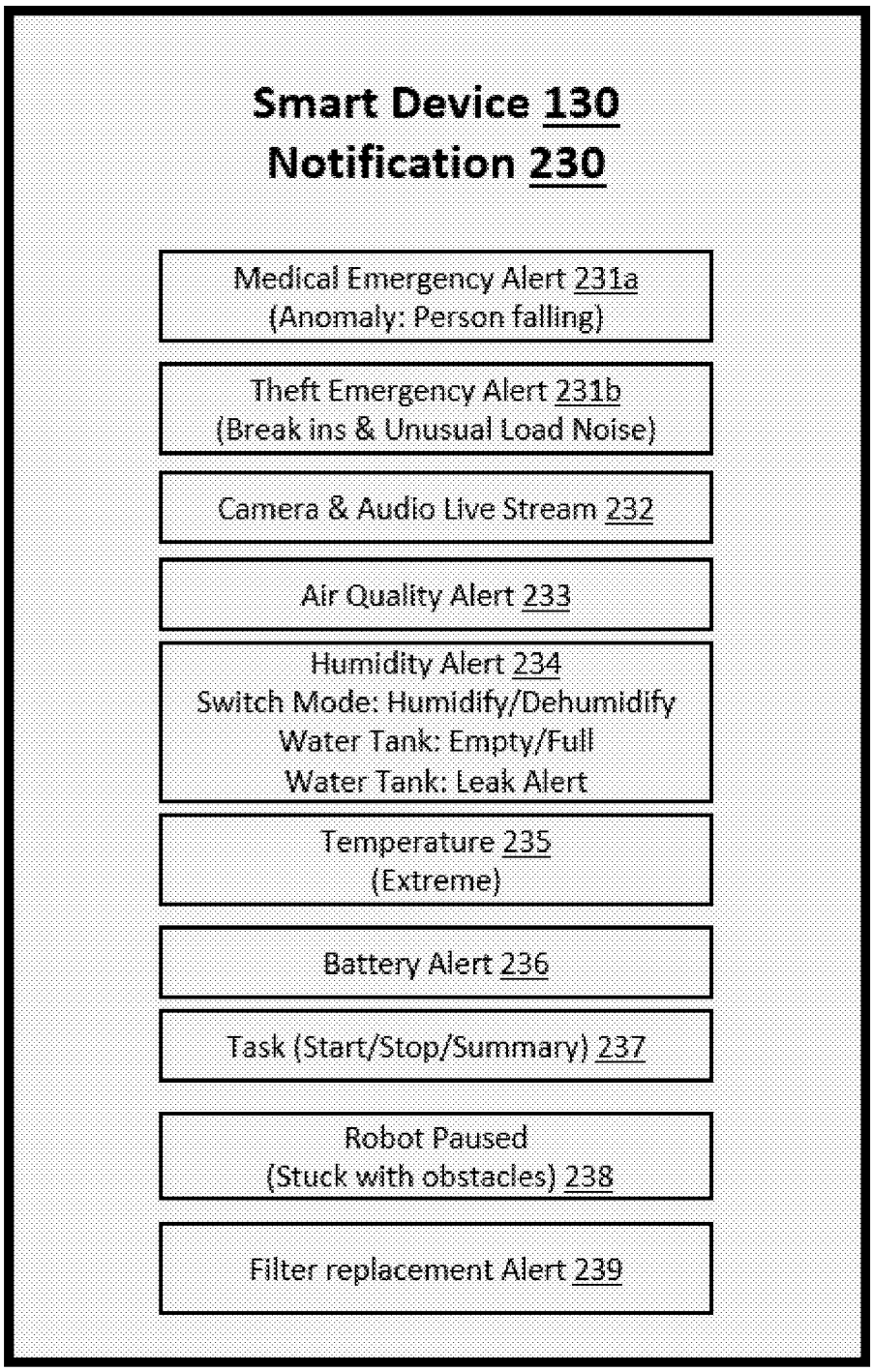
FIG. 14 is a conception view illustrating the smart robot of the current disclosure transmitting results of various notification, alerts, audio and video through a wireless communication module.

FIG. 14 shows the various notifications and alerts shared to user via a smart device during the operation of the robot. The medical emergency alert 231*a*, comes in when AI module 122 detects anomaly of person on the ground S323. The theft emergency alert 231*b*, gets triggered in when AI module 122 detects anomaly of sound for break-ins or unusual loud noise S312. The camera and audio live stream 232 triggers during emergency or as demand by the user. The air quality alert 233 happens based on various metrics of air quality by default or user values 223. The humidity alert 234 happens when the values are out of normal range. The smart robot as part of humidity management module 6, has humidifier system installed in it. However, when humidity is higher, then smart device notification alerts 234 user to replace humidifier unit with dehumidifier unit. As a non-limiting example, in summer months of some Michigan basements, humidity is higher. There are alerts 234 when the water tank is empty for humidifier and full for dehumidifier. Also, the alert 234 happens when the system detects any leak. The battery alert 236 gets triggered to charge the battery pack 35. When the task is completed, a summary 237 including start time, stop time, other metrics are shared. When robot gets stuck in a location 238 the user gets alerted. When the pre-filter 20 needs washing and other filter 22, 24 needs replacement; appropriate filter replacement alert 239 gets triggered.

Figure 16:
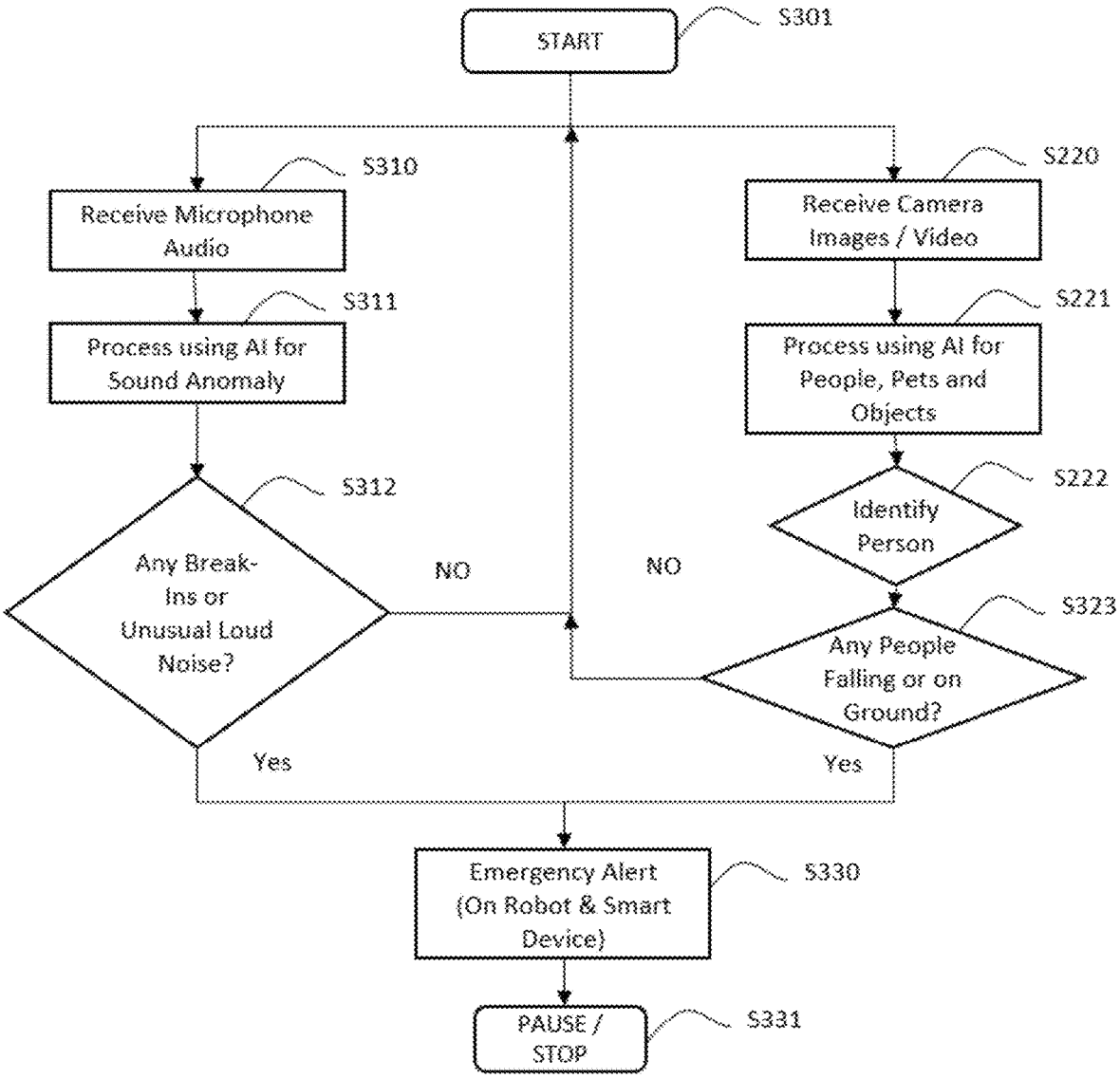
FIG. 16 is a flow chart illustrating the method of operation of using the data from microphone for audio and camera for images to provide emergency alerts.

FIG. 16 shows the emergency alert monitoring portion of the smart robot. The process is explained earlier as part of the camera and microphone description. This emergency alert system can operate as a standalone even when the regular air purification module is turned off. A standalone emergency alert system can be used during vacation or for other reasons. The alert 222 settings can be customized. The notification 160 happens on the physical robot itself through sound and LED lights. The notification happens on smart device 231*a*, 231*b*, 232.

Figure 17:
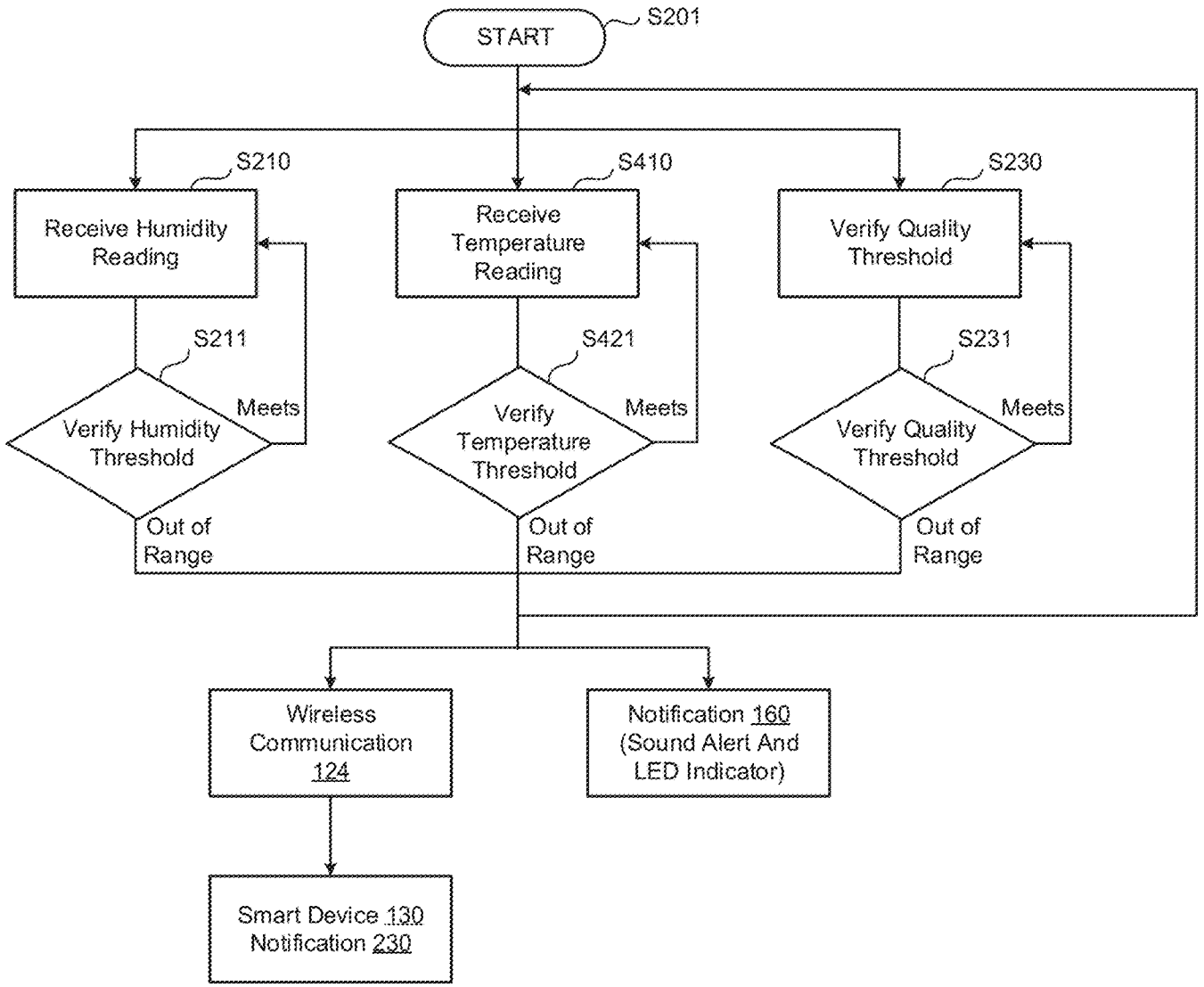
FIG. 17 is a flow chart illustrating the method of operation of using the data from various sensors and processing with threshold settings to provide alerts.
Figure 18:
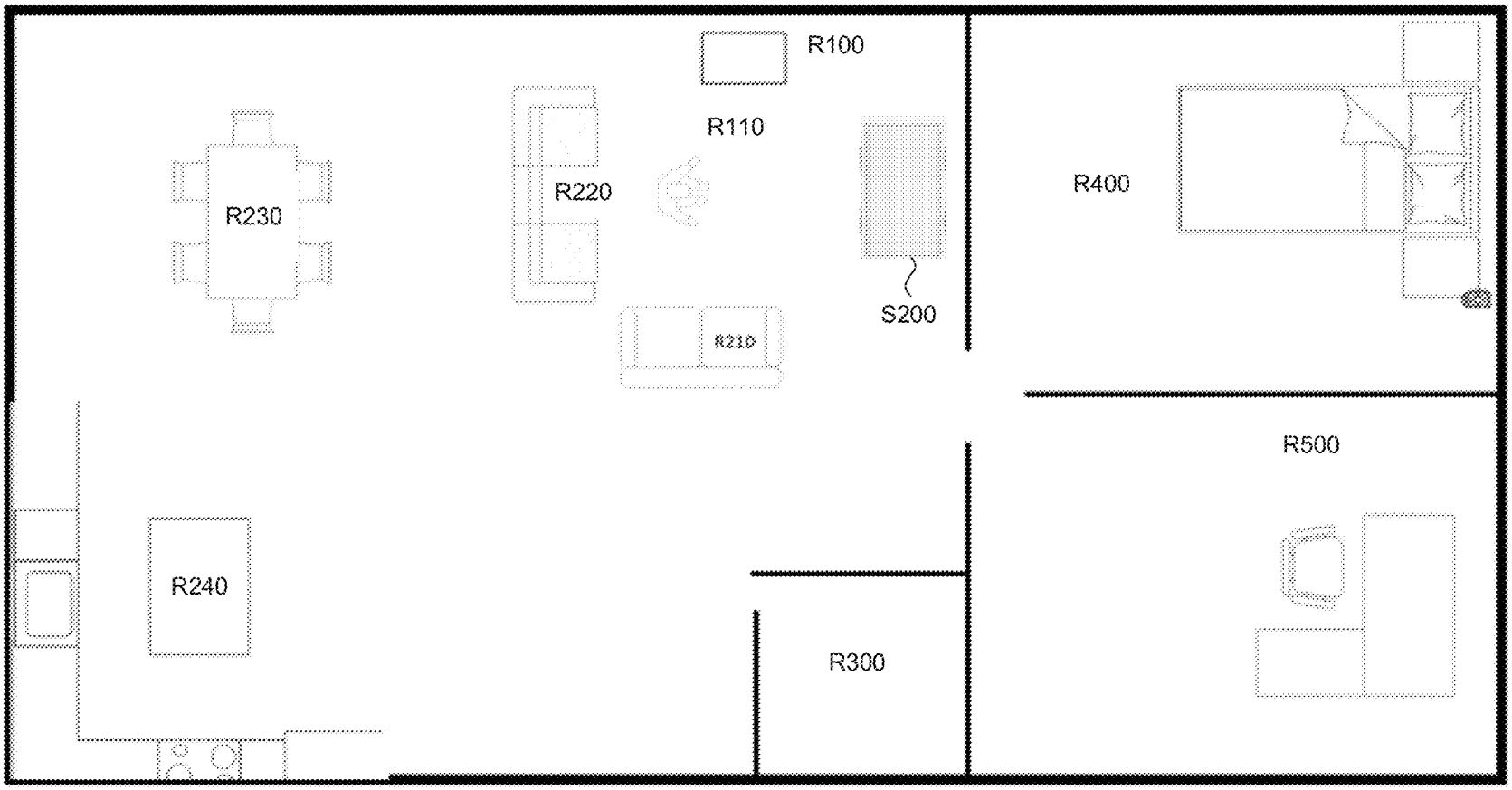
FIG. 18 is a top sketch view of a typical home where the smart robot is present to operate through multiple rooms.

FIG. 17 shows the flow of data related to the alerts of air quality metrics, temperature, and humidity ranges. When the robot starts S201, humidity sensor 16 provides the humidity reading S210. This value is checked to see if they meet the humidity threshold S211. This threshold could have been default or set by user 223. In parallel, the temperature sensor 40 provides the temperature reading S410. This value is checked to see if they meet the temperature threshold S421. This threshold could have been default or set by user 223. Also, in parallel, the air quality sensors 112 provides various readings S230. The various component of data are checked against its corresponding metrics of air quality for thresholds S231. This threshold could have been default or set by user 223. When any of these are out of range, the notification 160 is done on the smart robot itself through sound and LED indicator. Additionally, through wireless communication 124 the relevant notification 230 alerts are shared on smart device 130.

It is further an objective of the invention to provide a method, apparatus, and computer instructions for providing a robot which navigates space and stops when its sensors detect poor air, low or high humidity, or a person and cleans and disinfects the air for a short period of time, based on the sensor readings.

It is also an objective of the system to provide a method whereby it distributes clean air and humidity management evenly throughout a room.

It is further an objective of invention to use Artificial intelligence for smart handling of people, pets, and objects with data related to surrounding coming from sensor readings.

It is also an objective of invention to provide information about proximity with the help of camera and ultrasonic sensors to avoid obstacles in the way. This will help in preventing the collisions, floor transitions and resultant damages.

It is also an objective of invention to allow control of robot to have scheduled start, stop via smart device app. The robot can also move in non-autonomous mode with remote control capability through the mobile app.

Air quality, humidity, battery, water level of humidifier, dehumidifier may be monitored and alerted to users. Smart device app alerts if water in chamber reduces faster than normal rate; to indicate possible leak or discharge.

The robot by itself and through the app alerts the user if humidifier chamber must be replaced with dehumidifier chamber and vice versa.

It is also an objective of invention to alert remote users for unusual loud noise like breaking of windows or a person falling on the ground by processing data from microphone. It is also objective of invention to warn users for change in temperature around the robot through its temperature sensor.

It is also an objective of the invention to provide a smart robot which can also navigate from room to room to purify, humidify, dehumidify, and disinfect the air. The robot keeps moving to distribute clean, sanitized air and maintain humidity evenly. This capability is due to the ability to obtained real time data including AI to finds a person or detects poor air quality or humidity being out of range. The FIG. 17 shows a typical home with kitchen R240, dining area R230, 3-seater sofa R220, 2-seater sofa R210, table with television R200, a bathroom R300, a bedroom R400, and an office room R500. This smart robot R100 when turned on uses its AI capability and built in sensors and input devices, locates the person R110 nearby. Then it moves towards the person to start air purification, sanitization, and humidity management. It can work on this open space and move into bedroom R400 and to office room R500. This multi-functional robot can work on multiple rooms.

It is also an objective of the invention to provide a smart robot that can be used as a stationary air purifier, humidifier, dehumidifier, and disinfector, so fewer devices are needed to perform these tasks in each room.

It is further an objective of the invention to provide a device that may be suitable for human use of all ages and cover a variety of different applications for use indoors or limited outdoor on level ground like deck, patio, sunroom.

It is further an objective of the invention to provide a system which is easy to use, easy to implement and provides an advanced methodology of air purification and disinfection features.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

Although a smart robot has been described in terms of various embodiments, it is not intended that the invention be limited to these embodiments. Modification within the spirit of the invention will be apparent to those skilled in the art.

It is additionally noted and anticipated that although the device is shown in its most simple form, various components and aspects of the device may be differently shaped or modified when forming the invention herein. As such those skilled in the art will appreciate the descriptions and depictions set forth in this disclosure or merely meant to portray examples of preferred modes within the overall scope and intent of the invention and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the scope of the invention.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A smart air handling robot, comprising:

a main body;

a battery supported by the main body;

an air quality system having a first housing supported by the main body and having one or more purifying devices arranged in the first housing to disinfect air located within the first housing;

a humidity modifying system comprising at least one of a humidifier system or dehumidifier system, the humidity modifying system having a second housing that is supported by the main body, the humidity modifying system being constructed and arranged to change the humidity level of air in the second housing;

wherein the air quality system and humidity modifying system together at least partially define an air flow path through the first and second housings;

at least one fan positioned in the air flow path to produce a flow of air along the air flow path from an inlet end to an outlet end;

a sensor system comprising a plurality of air quality sensors supported by the main body;

at least one camera that captures real time images;

at least one microphone that captures sound pressure waves;

a central controller connected to receive data from the sensors, camera, and microphone, the central controller having a computer-readable memory and an electronic processor, the memory having stored thereon software comprising computer instructions that, when executed by the processor, operates to receive data from the sensor system, the camera, and the microphone, and perform operations assisted by artificial intelligence to process data and navigate the smart air handling robot, provide notifications, and communicate to a smart device; and a drive system comprising at least three bearing supports that include at least two driven wheel assemblies and a drive controller in operable communication with the central controller, each driven wheel assembly including a wheel and motor coupled to the wheel for providing drive power to the wheel, the drive controller being configured to power the motors;

wherein the air quality system further comprises:

an air filtration system comprising a fan-filter assembly comprising a pre-filter, the fan, and at least one primary filter; and a sanitizing system within the first housing, wherein the air filtration system and sanitizing system are located in the first housing along the air flow path; and wherein the air filtration system further comprises:

a pre-filter to remove at least one of lint, dust, fibers, or hair;

a first fan that pulls air from the environment;

an activated carbon filter downstream from the fan configured to filter out at least one of odors, smoke, or air contaminants including volatile organic compounds;

a HEPA air filter downstream from the activated carbon filter configured to remove at least one of dust, pollen, pollutants, or airborne particles; and a second fan downstream from the HEPA filter constructed and arranged to force air into the sanitizing system.

2. The smart air handling robot as in claim 1, wherein the air filtration system is constructed and arranged to receive air through the pre-filter via the fan, the air being filtered by the one or more primary filters, wherein the filtered air is then forced by the fan into the sanitizing system; and the sanitizing system further comprising an UVC light located in the first housing and constructed and arranged to control pathogens by killing bacteria, inactivating viruses, disinfecting the air flowing along the air flow path inside the first housing.

3. The smart air handling robot as in claim 2, wherein the UVC light intensity is adjusted based on a user configuration and real time data processed by an artificial intelligence portion of the central controller for presence of people and pets.

4. The smart air handling robot as in claim 1, wherein the first fan and second fan comprise variable fan speed control to adjust the flow rate of air through the fan-filter assembly based on real time data processed by the central controller as obtained by the sensor system.

5. A smart air handling robot, comprising:

a main body;

a battery supported by the main body;

an air quality system having a first housing supported by the main body and having one or more purifying devices arranged in the first housing to disinfect air located within the first housing;

a humidity modifying system comprising a humidifier system and a dehumidifier system, the humidity modifying system having a second housing that is supported by the main body, the humidity modifying system being constructed and arranged to change the humidity level of air in the second housing, wherein the humidifier system and the dehumidifier system are physically separate interchangeable modules and wherein the smart air handling robot is configured to allow either module, but not both, to be inserted into the air flow path to thereby either add or remove humidity from the air flowing through the second housing;

wherein the air quality system and humidity modifying system together at least partially define an air flow path through the first and second housings;

at least one fan positioned in the air flow path to produce a flow of air along the air flow path from an inlet end to an outlet end;

a sensor system comprising a plurality of air quality sensors supported by the main body;

at least one camera that captures real time images;

at least one microphone that captures sound pressure waves;

a central controller connected to receive data from the sensors, camera, and microphone, the central controller having a computer-readable memory and an electronic processor, the memory having stored thereon software comprising computer instructions that, when executed by the processor, operates to receive data from the sensor system, the camera, and the microphone, and perform operations assisted by artificial intelligence to process data and navigate the smart air handling robot, provide notifications, and communicate to a smart device; and a drive system comprising at least three bearing supports that include at least two driven wheel assemblies and a drive controller in operable communication with the central controller, each driven wheel assembly including a wheel and motor coupled to the wheel for providing drive power to the wheel, the drive controller being configured to power the motors.

6. The smart air handling robot as in claim 1, wherein the humidity modifying system further comprises a water tank and at least a water sensor constructed and arranged to provide the central controller with an indication of whether the tank is either empty or full.

7. The smart air handling robot as in claim 1, wherein the sensor system further comprises:

at least two air quality sensors to collect data of smoke, dust, and pollen particles of various sizes;

at least one air quality sensor to collect data of particles that are 10.0 microns or smaller in diameter;

at least one VOC sensor to measure for the presence of volatile organic compounds;

at least one humidity sensor to measure relative humidity;

at least one temperature sensor to measure surrounding temperature; and at least two ultrasonic sensors for measuring distance relative to nearby objects.

8. The smart air handling robot as in claim 7, wherein a first ultrasonic sensor is mounted at a front portion of the main body and is configured to detect obstacles in front of the smart air handling robot; and a second ultrasonic sensor is mounted underneath main body and is configured to perform cliff detection.

* * * * *